US007275970B2

(12) United States Patent
Hoshina

(10) Patent No.: US 7,275,970 B2
(45) Date of Patent: Oct. 2, 2007

(54) PLUG ERROR INSERTION PREVENTION SYSTEMS, PLUGS, PLUG INSERTION SECTIONS, PLUG CONTROL PROGRAMS, CONTACTLESS IDENTIFICATION TAG CONTROL PROGRAMS, AND PLUG INSERTION SECTION CONTROL PROGRAMS

(75) Inventor: Masaki Hoshina, Suwa (JP)

(73) Assignee: Seiko Epson Corporation (JP)

( * ) Notice: Subject to any disclaimer, the term of this patent is extended or adjusted under 35 U.S.C. 154(b) by 542 days.

(21) Appl. No.: 10/814,115

(22) Filed: Mar. 31, 2004

(65) Prior Publication Data

US 2004/0242087 A1 Dec. 2, 2004

(30) Foreign Application Priority Data

Apr. 1, 2003 (JP) ..... 2003-098271

(51) Int. Cl.
*H01R 4/50* (2006.01)

(52) U.S. Cl. ..... 439/894

(58) Field of Classification Search ..... 439/894, 439/373; 340/825, 539; 324/538, 537; 235/492
See application file for complete search history.

(56) References Cited

U.S. PATENT DOCUMENTS

| | | | | |
|---|---|---|---|---|
| 5,847,557 | A * | 12/1998 | Fincher et al. | 324/66 |
| 5,864,580 | A * | 1/1999 | Lowe et al. | 375/222 |
| 5,910,776 | A * | 6/1999 | Black | 340/10.1 |
| 6,002,331 | A * | 12/1999 | Laor | 340/539.1 |
| 6,784,802 | B1 * | 8/2004 | Stanescu | 340/687 |
| 2003/0061393 | A1 * | 3/2003 | Steegmans et al. | 709/250 |

* cited by examiner

*Primary Examiner*—Alexander Gilman
(74) *Attorney, Agent, or Firm*—Harness, Dickey & Pierce, P.L.C.

(57) ABSTRACT

Plug error insertion prevention systems, plugs, plug insertion sections, and programs for controlling the same are provided which are suitable for preventing plugs from being inserted in wrong insertion sockets. The plug error insertion prevention system includes a plug attached through a cable to a device, and a plug insertion section that is attached to a device. The plug is provided with a structure including a contactless identification tag and a connection section. The contactless identification tag is provided with a structure including a data reception section, a data transmission section, a data control section, a data storage section, a first state notification section, a display section, and a power generation section. The plug insertion section is provided with a structure including a data reception section, a data transmission section, a data control section, a data storage section, a response information generation section, a second state notification section, first through third display sections, and first through third insertion sockets.

20 Claims, 7 Drawing Sheets

PLUG ERROR INSERTION PREVENTION SYSTEMS, PLUGS, PLUG INSERTION SECTIONS, PLUG CONTROL PROGRAMS, CONTACTLESS IDENTIFICATION TAG CONTROL PROGRAMS, AND PLUG INSERTION SECTION CONTROL PROGRAMS

RELATED APPLICATIONS

This application claims priority to Japanese Patent Application No. 2003-098271 filed Apr. 1, 2003 which is hereby expressly incorporated by reference herein in its entirety.

BACKGROUND

1. Technical Field of the Invention

The present invention relates to plugs and plug insertion sections, and more particularly to plug error insertion prevention systems that are suitable to prevent plugs from being inserted in incorrect insertion sockets.

2. Conventional Technology

Conventionally, in order not to insert a plug of a power plug socket into a wrong socket, some ideas have been devised for matching the two for making clear a right combination of the two, such as coloring the plug and the socket in the same color. If a device is sold with a predetermined set of a plug and a socket, this kind of matching of the two can be clearly made by coloring the plug and the socket in the same color in a manufacturing stage. However, there are many devices having plugs which are sold separately from devices having sockets for plugs. When one of them or both of them are separately purchased, the purchaser needs to make a certain matching of the two.

However, even when a matching is made in advance, there is still a possibility that a plug may be inserted in the wrong socket, when their indications are located in positions which make them difficult to view, or when the device is installed in a dark place and the contents of the matching is misunderstood. In these situations, the device may be destroyed by short-circuit, destroyed by excess voltage applied to the device, and in the worst case, there is a danger that the device catches fire or explodes.

Also, when the purchaser makes him/herself a match, in order to judge if an insertion socket is a correct one, it is necessary to confirm a correct combination of a plug and the insertion socket by inserting the plug once in the socket. In this instance, there is a possibility that the plug may be inserted in the wrong and different insertion socket. In such a case, there are also dangers similar to those described above.

When a match is made without confirming whether a combination of a plug and an insertion socket is correct, and a wrong match is made between a plug and an insertion socket, there is a possibility that a plug may be inserted in the wrong insertion socket. In such a case, there are also dangers similar to those described above.

In view of the above, the present invention has been made through aiming at the unsolved problems of the conventional technology, and it is an object of the present invention to provide plug error insertion prevention systems, plugs, plug insertion sections, plug control programs, contactless identification tag control programs, and plug insertion section control programs.

SUMMARY

To achieve the object described above, a plug error insertion prevention system in accordance with the present invention concerns a plug error insertion prevention system that prevents a plug used for a specified usage from being inserted in the wrong plug insertion socket when the plug is inserted in the plug insertion socket of a plug insertion section, the plug error insertion prevention system characterized in that:

the plug is equipped with first identification information storage means that stores first identification information that is information for identifying a plug insertion socket corresponding to the plug, plug insertion socket information transmission means that sends-the first identification information to the plug insertion socket upon approaching the plug insertion socket of the plug insertion section, response information receiving means that receives response information from the plug insertion section, and plug state notification means that notifies a system user of the state of the plug for the plug insertion socket based on the response information received by the response information receiving means, and the plug insertion section is equipped with second identification information storage means that stores second identification information that is information for identifying the plug corresponding to the plug insertion socket of the plug insertion section, first identification information receiving means that receives the first identification information sent from the plug, identification information comparing means that compares the first identification information received by the first identification information receiving means and the second identification information, response information generation means that generates response information to the plug based on a comparison result of the identification information comparing means, response information transmission means that sends the response information generated by the response information generation means to the plug, and plug insertion socket state notification means that notifies the system user of the state of the plug insertion socket for the plug.

With the structure described above, in accordance with the first aspect, the plug can store within the first identification information storage means the first identification information that is information for identifying a plug insertion socket corresponding to the plug, can send by the plug insertion socket information transmission means the first identification information to the plug insertion socket upon approximating to (coming close to or approaching) the plug insertion socket of the plug insertion section, can receive by the response information receiving means response information from the plug insertion section, and can notify by the plug state notification means a system user of the state of the plug for the plug insertion socket based on the response information received by the response information receiving means; and the plug insertion section can store by the second identification information storage means second identification information for identifying the plug corresponding to the plug insertion socket of the plug insertion section, can receive by the first identification information receiving means the first identification information sent from the plug, can compare by the identification information comparing means the first identification information received by the first identification information receiving device and the second identification information, can generate by the response information generation means response information to the plug based on a comparison result of the identification information comparing means, can send by the response information transmission device the response information generated by the response information generation means to the plug, and can notify by the plug insertion socket state notification means the system user of the state of the plug insertion socket for the plug.

Accordingly, when the plug approaches the plug insertion socket, whether or not the plug insertion socket matches with the plug can be confirmed, such that the system user can be prevented from inserting a plug into the wrong plug insertion socket.

Here, the plug described above is an insertion device that is used for connecting or disconnecting a circuit in an electric machine, which is generally attached to a cable or a component that can be attached or detached, and can be inserted in a plug insertion socket of a plug insertion section, such as, a jack, an outlet, a receptacle, a socket and a plug socket. It is noted that devices that are called by different names such as pins and connectors are also included as long as they are used for electrical connection.

Also, the plug state notification means notifies a system user of the state of the plug by light, sound, and/or image (including characters) display. For example, if a plug insertion socket approaching is a matching one, a blue light may be flashed, sound or voice indicating the match may be outputted, or an image in a blue color may be displayed. On the other hand, if it is not a matching one, a red light may be flashed, sound or voice indicating a lack of matching may be outputted, or an image in a red color may be displayed.

Also, the plug insertion socket state notification means notifies a system user of the state of the plug insertion socket being approached by the plug by light, sound, and/or image (including characters) display. For example, if a plug approaching is a matching one, a blue light may be flashed, sound or voice indicating the match may be outputted, or an image in a blue color may be displayed. On the other hand, if it is not a matching one, a red light may be flashed, sound or voice indicating a lack of matching may be outputted, or an image in a red color may be displayed.

Further, the second aspect is characterized in that, in the first aspect, the plug is equipped with a contactless identification tag, and the contactless identification tag is equipped with the first identification information storage means that stores first identification information that is information for identifying a plug insertion socket corresponding to the plug, the plug insertion socket information transmission means that sends the first identification information to the plug insertion socket upon approaching the plug insertion socket of the plug insertion section, the response information receiving means that receives response information from the plug insertion section, and the plug state notification means that notifies a system user of the state of the plug for the plug insertion socket based on the response information received by the response information receiving means.

More specifically, the contactless identification tag can store by the first identification information storage means first identification information that is information for identifying a plug insertion socket corresponding to the plug, can send by the plug insertion socket information transmission means the first identification information to the plug insertion socket upon approaching the plug insertion socket of the plug insertion section, can receive by the response information receiving means response information from the plug insertion section, and can notify by the plug state notification means a system user of the state of the plug for the plug insertion socket based on the response information received by the response information receiving means.

Accordingly, for example, merely by attaching a contactless identification tag to an ordinary plug, and bringing the plug proximate (near) a plug insertion socket, whether or not the plug insertion socket matches with the plug can be confirmed, such that the system user can be prevented from inserting the plug into the wrong plug insertion socket. Furthermore, merely by attaching a contactless identification tag to a plug, the plug can be used in the system of the present invention, and therefore the present invention can be readily applied to a variety of different kinds of plugs.

Here, a contactless identification tag is used in a RFID (Radio Frequency Identification) system, and is generally called a data carrier. There are a variety of different types, such as, a label type, a card type, a coin type, a stick type, and the like. The types have close correlation with their applications. For example, those that are carried by persons may be in the form of a key holder that is modified from the card type or the label type. Also, as a semiconductor carrier ID, the stick type is the most popular. It is noted that the coin type is the most popular in those that are sewn in cloths relating to linens.

Also, a contactless identification tag may be equipped with a storage region that is dedicated to data reading, or where data can be freely read from and written in, and further, can be operated through contactless power transmission from an antenna side even without a battery.

Also, the RFID system is an ID system that uses a radio wave or electromagnetic wave as a medium, and the contactless identification tag is equipped with three characteristics of, (1) being a size that can be readily carried, (2) storing information in an electronic circuit, and (3) communicating through contactless communications.

Therefore, the RFID system is used for the purpose of unifying persons, items, vehicles carrying contactless identification tags with their information. In other words, where there are persons, items and vehicles, required information can be retrieved at any time and new information can be written as necessary.

There are four representative types of the RFID system, i.e., an inductive coupling system that communicates with a contactless identification tag, primarily using mutual induction of coils by an, alternating magnetic filed, an electromagnetic induction system that communicates with a contactless identification tag, primarily using electromagnetic waves in a long or medium wavelength range that is 250 kHz or below, or a 13.56 MHz band, a microwave system that performs data communication between a reader/writer side antenna and a contactless identification tag with microwaves in a 2.45 GHz band, and an optical system that is provided with an LED as a light generation source and a phototransistor as a light sensor to communicate with a contactless identification tag using spatial transmission of light.

Also, there are mainly four access modes, i.e., a single access mode, a FIFO (First In First Out) access mode, a multiple-access mode, and a selective access mode.

The single access mode uses a single contactless identification tag that is present within an antenna communications region. If a plurality of contactless identification tags are present within the antenna communications region, a communication error occurs, and no communications can be made.

In the FIFO access mode, communications can be made sequentially with contactless identification tags that sequentially enter an antenna communications region. An access prohibition process is performed on a contactless identification tag that once completes a communication session. Therefore, even when a plurality of tags that have completed communications are present in the antenna communications region, communications can be made if only one new tag comes in the antenna communications region. When multiple contactless identification tags simultaneously enter the antenna communications region, a communication error occurs, and communications cannot be made. The contactless identification tags with which accesses are prohibited can communicate again once they are outside the communications region.

In the multiple-access mode, even when a plurality of contactless identification tags are present in an antenna communications region, communications can be made with all of the contactless identification tags.

In the selective access mode, communications can be made with a specified contactless identification tag among a plurality of contactless identification tags that are present in an antenna communications region. This can be realized by a command to allocate a number to each contactless identification tag within the communications region and a command to make communications with a specified contactless identification tag based on the allocated number.

Also, the third aspect is characterized in that, in the first or second aspect, the plug is equipped with electric power generation means that generates electric power for driving the plug with an electromagnetic wave transmitted from the plug insertion section, and the plug insertion section is equipped with power supply electromagnetic wave transmission means that transmits electromagnetic wave for supplying electric power to the plug when approaching the plug insertion section.

More specifically, the plug can generate by the electric power generation means electric power for driving the plug with electromagnetic wave transmitted from the plug insertion section, and the plug insertion section can transmit by power supply electromagnetic wave transmission means electromagnetic wave for supplying electric power to the plug that approaches the plug insertion section.

Accordingly, the plug side can operate even without a power source such as a battery, such that its functional section can be made smaller.

Also, the fourth aspect is characterized in that, in any one of the first through third aspects, the plug state notification means includes a plug state display section, such that specified information can be displayed on the plug state notification section to thereby notify the system user of the state of the plug for the plug insertion socket.

More specifically, the plug state notification means includes a plug state display section, and by displaying specified information on the plug state notification section, the system user can be notified of the state of the plug for the plug insertion socket.

Accordingly, the system user can readily find the state of the plug, such as, the state as to whether or not the plug matches with the plug insertion socket, by visual observation. Also, by matching the display content (the color of a color image or the like) and the display content (the color of a color image) on the side of the plug insertion socket, the condition of the two can be readily learned. Also, the plug state display section may be given a device to make the display readily viewable, for example, the plug state display section may be made with a bendable member such that it can be wound around the plug.

Also, the fifth aspect is characterized in that, in any one of the first through fourth aspects, the plug state display section is formed from a light emitting element, thereby notifying the system user of the state of the plug for the plug insertion socket by the state of light emission of the light emitting element.

In other words, the plug state display section is formed from a light emitting element, thereby notifying the system user of the state of the plug for the plug insertion socket by the state of light emission of the light emitting element.

Accordingly, the system user can readily learn the state of the plug, for example, as to whether or not the plug matches with the plug insertion socket, by visual observation. Also, by indicating the state through using colors of light, or through flashing light, the condition can be readily learned by visual observation even in the darkness. Here, as the light emitting section, LEDs or the like may be used. Also, the LEDs can be contrived in terms of the number thereof to be mounted and positions thereof to be mounted to make their light emitting state readily viewable.

Also, the sixth aspect is characterized in that, in the fifth aspect, the plug state display section is disposed at a specified position of the plug at which a correct insertion position of the plug to the plug insertion socket can be guided.

In other words, due to the fact that the plug state display section is disposed at a specified position of the plug at which a correct insertion position of the plug to the plug insertion socket can be guided, the insertion positions can be matched by using the position of the light emitting section as a guide in a combination of a plug and a plug insertion-socket with which a correct insertion cannot be made unless the two are in a specified positional relation, such as those of a PS2 terminal, a USB (Universal Serial Bus) terminal, and a video S terminal, and therefore the plug can be readily inserted in the plug insertion socket in the darkness.

Also, the seventh aspect is characterized in that, in the fifth or the sixth aspects, the plug state notification means changes the state of light emission of the light emitting element according to positions of the plug with respect to the plug insertion socket.

In other words, the plug state notification means can change the state of light emission of the light emitting element according to positions of the plug with respect to the plug insertion socket.

Accordingly, by notifying based on the state of light emission of the light emitting element as to whether or not the plug is in a correct position with respect to the plug insertion socket, whether or not the plug and the plug insertion socket are in a correct positional relation can be learned based on the disposed position of the plug state display section and its light emission state, such that the plug can be more readily inserted into the plug insertion socket in the darkness.

Also, the eighth aspect is characterized in that, in any one of the first through seventh aspects, the plug insertion socket state notification means includes a plug insertion socket state display section, such that specified information is displayed on the plug insertion socket state display section to thereby notify the system user of the state of the plug insertion socket for the plug.

In other words, the plug insertion socket state notification means includes a plug insertion socket state display section, such that the system user can be notified of the state of the plug insertion socket for the plug by displaying specified information on the plug insertion socket state display section.

Accordingly, the system user can readily find the state of the plug insertion socket, such as, the state as to whether or not the plug insertion socket matches with the plug that is approaching the plug insertion socket, by visual observation. Also, by matching the display content (the color of a color image or the like) and the display content (the color of a color image) on the side of the plug, the conditions of the two can be readily confirmed.

Also, the ninth aspect is characterized in that, in any one of the first through eighth aspects, the plug insertion socket state display section is formed from a light emitting element, and notifies the system user of the state of the plug insertion socket for the plug by the state of light emission of the light emitting element.

In other words, the plug insertion socket state display section is formed from a light emitting element, and is capable of notifying the system user of the state of the plug insertion socket for the plug by the state of light emission of the light emitting element.

Accordingly, the system user can readily find the state of the plug insertion socket, such as, the state as to whether or not the plug insertion socket matches with the plug that is approaching the plug insertion socket, by visual observation. In addition, by indicating the state by using colors of light, or by flashing light, the condition can be readily confirmed by visual observation even in the darkness.

Also, the tenth aspect is characterized in that, in the ninth aspect, the plug insertion socket state display section is disposed at a specified position of the plug insertion section at which a correct insertion position of the plug can be guided when inserting the plug into the plug insertion socket.

In other words, due to the fact that the plug insertion socket state display section is disposed at a specified position of the plug insertion section at which a correct insertion position of the plug can be guided when inserting the plug into the plug insertion socket, the insertion positions can be matched by using the position of the light emitting section as a guide in a combination of a plug and a plug insertion socket with which a correct insertion cannot be made unless the two are in a specified positional relation, such as those of a PS2 terminal, a USB terminal, and a video S terminal, and therefore the plug can be readily inserted in the plug insertion socket in the darkness.

Also, the eleventh aspect is characterized in that, in the ninth or the tenth aspects, the plug insertion socket state notification means changes the state of light emission of the light emitting element according to positions of the plug with respect to the plug insertion socket.

In other words, the plug insertion socket state notification means is capable of changing the state of light emission of the light emitting element according to positions of the plug with respect to the plug insertion socket Accordingly, by notifying based on the state of light emission of the light emitting element as to whether or not the plug approaching is in a correct position with respect to the plug insertion socket, whether or not the plug and the plug insertion socket are in a correct positional relation can be confirmed based on the disposed position of the plug insertion socket state display section and its light emission state, such that the plug can be more readily inserted into the plug insertion socket in the darkness.

Also, the twelfth aspect is characterized in that, in any one of the first through the eleventh aspects, the first identification information includes characteristic information of an owner of the plug, the plug insertion section is equipped with usability judging means that judges based on the characteristic information included in the first identification information received as to whether the plug that is a transmission source of the characteristic information can use the plug insertion socket of the plug insertion section, and the response information generation means generates the response information based also on a judgment result of the usability judging means.

In other words, the first identification information includes information characteristic to an owner of the plug, the plug insertion section can judge by the usability judging means based on the characteristic information included in the first identification information received as to whether the plug that is a transmission source of the characteristic information can use the plug insertion socket of the plug insertion section, and the response information generation means can generate the response information based also on a judgment result of the usability judging means.

Accordingly, with the information characteristic to the owner of a plug, whether or not the plug can use a plug insertion section can be judged. Therefore, when a plug that cannot be used is inserted in an insertion socket, the function of the plug insertion section or a device having the plug insertion section can be prevented from being used. Further, the owner of a plug may be verified, and only when verified, the use of a device may be permitted or a specified service may be provided.

Also, the thirteenth aspect concerns a plug that is applicable to the first aspect, and the plug is characterized in comprising: first identification information storage means that stores first identification information that is information for identifying a plug insertion socket corresponding to the plug; plug insertion socket information transmission means that sends the first identification information to the plug insertion socket upon approaching the plug insertion socket of the plug insertion section; response information receiving means that receives response information from the plug insertion section; and plug state notification means that notifies a system user of the state of the plug for the plug insertion socket based on the response information received by the response information receiving means.

Here, the present invention concerns a plug that is applicable to the first aspect, and its functions and effects may be duplicative of the above, and therefore their description is omitted.

Further, the fourteenth aspect concerns a plug insertion section that is applicable to the first aspect, and the plug insertion section is characterized in comprising: second identification information storage means that stores second identification information that is information for identifying the plug corresponding to the plug insertion socket of the plug insertion section; first identification information receiving means that receives the first identification information sent from the plug; identification information comparing means that compares the first identification information received by the first identification information receiving means and the second identification information; response information generation means that generates response information to the plug based on a comparison result of the identification information comparing means; response information transmission means that sends the response information generated by the response information generation means to the plug; and plug insertion socket state notification means that notifies the system user of the state of the plug insertion socket for the plug.

Here, the present invention concerns a plug insertion section that is applicable to the first aspect, and its functions and effects are duplicative of the above, and therefore their description is omitted.

Further, the fifteenth aspect concerns a plug control program for controlling the thirteenth aspect, and the program is characterized in comprising: a plug insertion socket information transmission step of sending the first identification information to the plug insertion socket upon approaching the plug insertion socket of the plug insertion section; a response information receiving step of receiving response information from the plug insertion section; and a plug state notification step of notifying a system user of the state of the plug for the plug insertion socket based on the response information received in the response information receiving step.

Here, the present invention concerns a program for controlling the thirteenth aspect, and its effects are duplicative of the above, and therefore its description is omitted.

Further, the sixteenth aspect concerns a program for controlling the contactless identification tag in the second aspect, and is characterized in comprising: a plug insertion socket information transmission step of sending the first identification information to the plug insertion socket when the plug approaches the plug insertion socket of the plug insertion section; a response information receiving step of receiving response information from the plug insertion section; and a plug state notification step of notifying a system user of the state of the plug for the plug insertion socket based on the response information received in the response information receiving step.

Here, the present invention concerns a program for controlling a contactless identification tag in the second aspect, and its effects are duplicative of the above, and therefore its description is omitted.

Further, the seventeenth aspect concerns a program for controlling the plug insertion section in the fourteenth aspect, the program characterized in comprising: a plug insertion socket information receiving step of receiving the first identification information sent from the plug; a plug insertion socket information comparing step of comparing the first identification information received in the plug insertion socket information receiving step and the second identification information; a response information generation step of generating response information to the plug based on a comparison result of the plug insertion socket information comparing step; a response information transmission step of sending the response information generated in the response information generation step to the plug; and a plug insertion socket state notification step of notifying the system user of the state of the plug insertion socket for the plug.

Here, the present invention concerns a program for controlling the fourteenth aspect, and its effects are duplicative of the above, and therefore its description is omitted.

The present invention can further include the following embodiments:

(1) The plug defined in the thirteenth aspect characterized gin comprising a contactless identification tag, wherein the contactless identification tag is equipped with first identification information storage means that stores first identification information that is information for identifying a plug insertion socket corresponding to the plug, plug insertion socket information transmission means that sends the first identification information to the plug insertion socket upon approaching the plug insertion socket of the plug insertion section, response information receiving means that receives response information from the plug insertion section, and plug state notification means that notifies a system user of the state of the plug for the plug insertion socket based on the response information received by the response information receiving means.

(2) The plug defined in the thirteenth aspect or the embodiment (1) above characterized in comprising electric power generation means that generates electric power for driving the plug with electromagnetic wave transmitted from the plug insertion section.

(3) The plug defined in any one of the thirteenth aspect and the embodiments (1) and (2) above characterized in that the plug state notification means includes a plug state display section such that specified information is displayed on the plug state notification section to thereby notify the system user of the state of the plug for the plug insertion socket.

(4) The plug defined in any one of the thirteenth aspect and the embodiments (1) through (3) above characterized in that the plug state display section is formed from a light emitting element, and notifies the system user of the state of the plug for the plug insertion socket by the state of light emission of the light emitting element.

(5) The plug defined in the embodiment (4) above characterized in that the plug state display section is disposed at a specified position of the plug at which a correct insertion position of the plug to the plug insertion socket can be guided.

(6) The plug defined in the embodiment (4) or (5) above characterized in that the plug state notification means changes the state of light emission of the light emitting element according to positions of the plug with respect to the plug insertion socket.

(7) The plug defined in any one of the thirteenth aspect and the embodiments (1) through (6) above characterized in that the first identification information includes characteristic information of an owner of the plug.

(8) The plug insertion section defined in the fourteenth aspect characterized in comprising power supply electromagnetic wave transmission means that transmits electromagnetic wave for supplying electric power to the plug that approximates to the plug insertion section.

(9) The plug insertion section defined in the fourteenth aspect or the embodiment (8) above characterized in that the plug insertion socket state notification means includes a display section, such that specified information is displayed on the display section to thereby notify the system user of the state of the plug insertion socket for the plug.

(10) The plug insertion section defined in any one of the fourteenth aspect and the embodiments (8) and (9) above characterized in that the plug insertion socket state notification means includes a plug insertion socket state display section, such that specified information is displayed on the plug insertion socket state display section to thereby notify the system user of the state of the plug insertion socket for the plug.

(11) The plug insertion section defined in the embodiment (10) above characterized in that the plug insertion socket state display section is formed from a light emitting element, and notifies the system user of the state of the plug insertion socket for the plug by the state of light emission of the light emitting element.

(12) The plug insertion section defined in the embodiment (10) or (11) above characterized in that the plug insertion socket state display section is disposed at a specified position of the plug insertion section at which a correct insertion position of the plug can be guided when inserting the plug into the plug insertion socket.

(13) The plug insertion section defined in any one of the embodiments (10) through (12) above characterized in that the plug insertion socket state notification means changes the state of light emission of the light emitting element according to positions of the plug with respect to the plug insertion socket.

(14) The plug insertion section defined in any one of the fourteenth aspect and the embodiments (8) through (13) above characterized in comprising usability judging means that judges based on the characteristic information included in the first identification information received as to whether the plug that is a transmission source of the characteristic information can use the plug insertion socket of the plug insertion section, and the response information generation means generates the response information based also on a judgment result of the usability judging means.

BRIEF DESCRIPTION OF THE DRAWINGS

FIG. 4(*b*) is a diagram illustrating a second embodiment of a plug error insertion prevention system 1.

DETAILED DESCRIPTION

Embodiments of the present invention will be described below with reference to the accompanying drawings. FIGS. 1 through 7 are views of a plug error insertion prevention system in accordance with an embodiment of the present invention.

Figure 1:
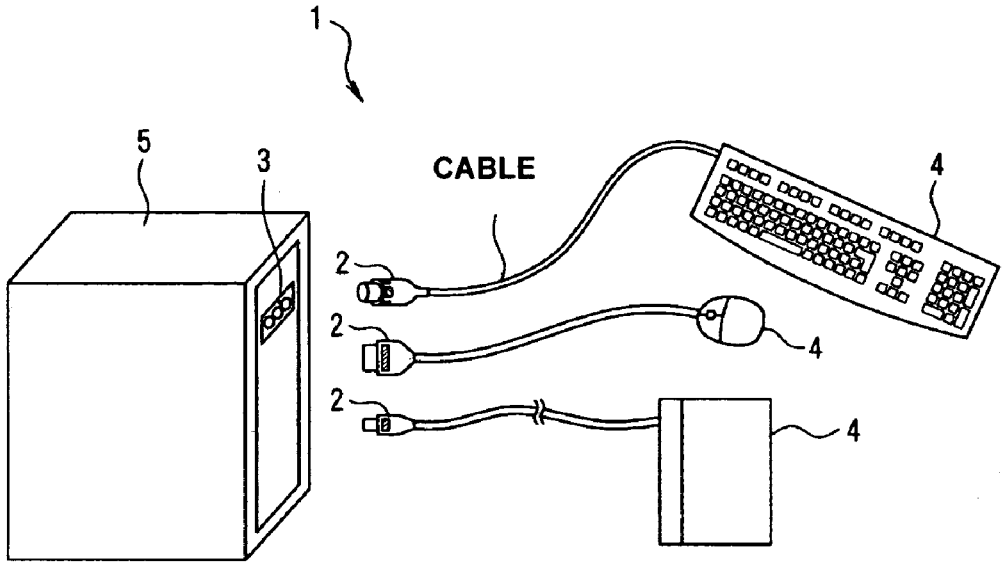
FIG. 1 is a diagram illustrating the outline of a plug error insertion prevention system in accordance with the present invention.

First, a structure of the plug error insertion prevention system in accordance with the present invention will be described based on FIG. 1. FIG. 1 shows a general overview of the plug error insertion prevention system in accordance with the present invention.

The plug error insertion prevention system 1 is structured to include plugs 2 attached to devices 4 through cables and a plug insertion section 3 attached to a back face of a device 5.

The plugs 2 include connection sections that electrically connect the devices 4 and the device 5 by inserting them into first through third insertion sockets 3*g*-3*i* (to be describe below) of the plug insertion section 3, and further have a function to warn the user so that they are not inserted into wrong insertion sockets. Details thereof will be described below.

The plug insertion section 3 includes first through third insert sockets 3*g*-3*i* (see FIG. 3), and the device 5 and the devices 4 are electrically connected by inserting the plugs 2 into the first through third insertion sockets 3*g*-3*i*. Further, plug insertion section 3 has a function to warn the user so that the plugs 2 are not wrongly inserted into the first through third insertion sockets 3*g*-3*i*. Details thereof will be described below.

The devices 4 are used as they are connected to the device 5 through the plugs 2, and can be devices such as a keyboard and a mouse when the device 5 is a PC (Personal Computer), for example.

The device can be an electric device having the plug insertion section 3, such as, for example, a PC, an audio set, a video player, a DVD player or a TV, and can be connected to a variety of electric devices through cables having the plugs 2, such as, AV cables, LAN cables or the like.

Figure 2:
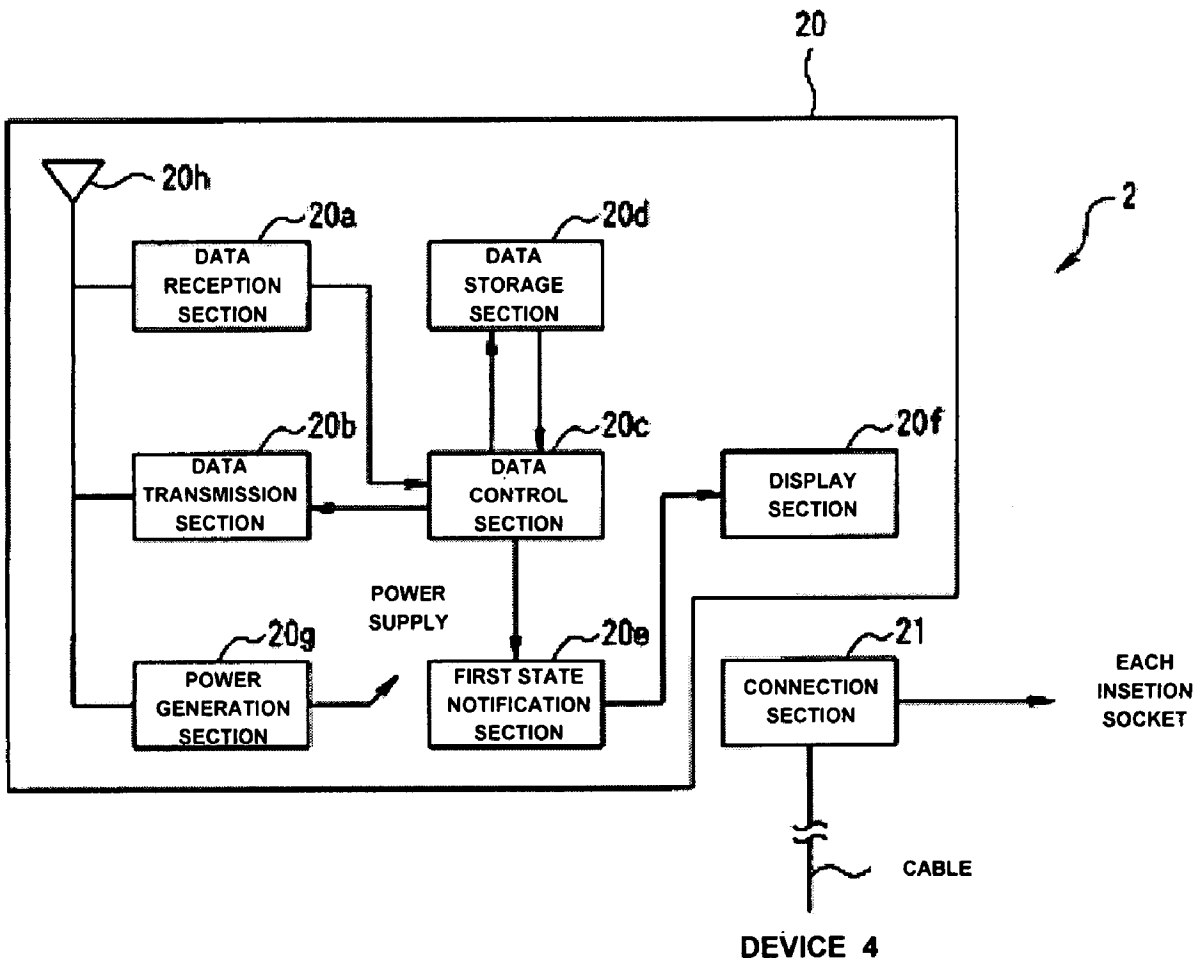
FIG. 2 is a block diagram of a detailed structure of a plug 2.

Further, referring to FIG. 2, the structure of the plug 2 will be described in detail. FIG. 2 is a block diagram indicating a detailed structure of the plug 2.

As indicated in FIG. 2, the plug 2 has a structure including a contactless identification tag 20 and a connection section 21.

The contactless identification tag 20 has a structure including a data reception section 20*a*, a data transmission section 20*b*, a data control section 20*c*, a data storage section 20*d*, a first state notification section 20*e*, a display section 20*f* and a power generation section 20*g*.

The data reception section 20*a* is equipped with a function to receive, by an electromagnetic induction method, data that is transmitted from the plug insertion section 3 by using electromagnetic wave in the 13.5 MHz band, for example.

The data transmission section 20*b* is equipped with a function to transmit, by an electromagnetic induction method, specified data stored in the data storage section 20*d* to the plug insertion section 3, using electromagnetic wave in the 13.56 MHz band, for example.

The data control section 20*c* controls processings to receive data by the data reception section 20*a* and processings to send data by the data transmission section 20*b*. Further, it analyzes data received from the plug insertion section 3 and transfers an analysis result to the first state notification section 20*e*; or reads out relevant data stored in the data storage section 20*d* and transfers the data to the first state notification section 20*e*. In accordance with the present embodiment, in response to a response request command signal sent from the plug insertion section 3, identification information and information of a corresponding insertion socket stored in the data storage section 20*d* are transmitted to the plug insertion section 3.

The data storage section 20*d* is a nonvolatile semiconductor memory such as a flash memory, which retains data once stored without a power supply. It is noted that the data storage section 20*d* includes a protected region (a region where data therein cannot be rewritten), which stores data necessary for operations, such as, information about an insertion socket corresponding to each contactless identification tag 20, identification information characteristic to each contactless identification tag 20.

The first state notification section 20*e* transfers to the display section 20*f* control commands based on response information received from the plug insertion section 3 through the data reception section 20*a*, and according to the contents of the responses.

The display section 20*f* is composed of a plurality of light emitting elements, and notifies the user of the state of each of the first through third insertion sockets 3*j*-3*l* (to be described below) of the plug insertion section 3 for the plugs 2 by emitting light from the light emitting elements based on control commands sent from the first state notification section 20*e*.

For example, when a plug 2 approaches a plug insertion section having a matching insertion socket, the light emitting elements are made to emit light such that they appear to be blue. When it approaches a plug insertion section having an unmatched insertion socket, the light emitting elements are made to emit light such that they appear to be red. Also, the light emitting elements may be flashed.

The power generation section 20*g* generates electric power for driving each of the sections 20*a*-20*f* in the contactless identification tag 20 from carrier waves of data signals received from the plug insertion section 3 through an antenna 20*h*, and supplies the power.

The antenna 20*h* is formed from metal ink or the like on a substrate of the contactless identification tag 20, and is capable of transmitting and receiving electromagnetic wave in the 13.56 MHz band, for example.

Figure 3:
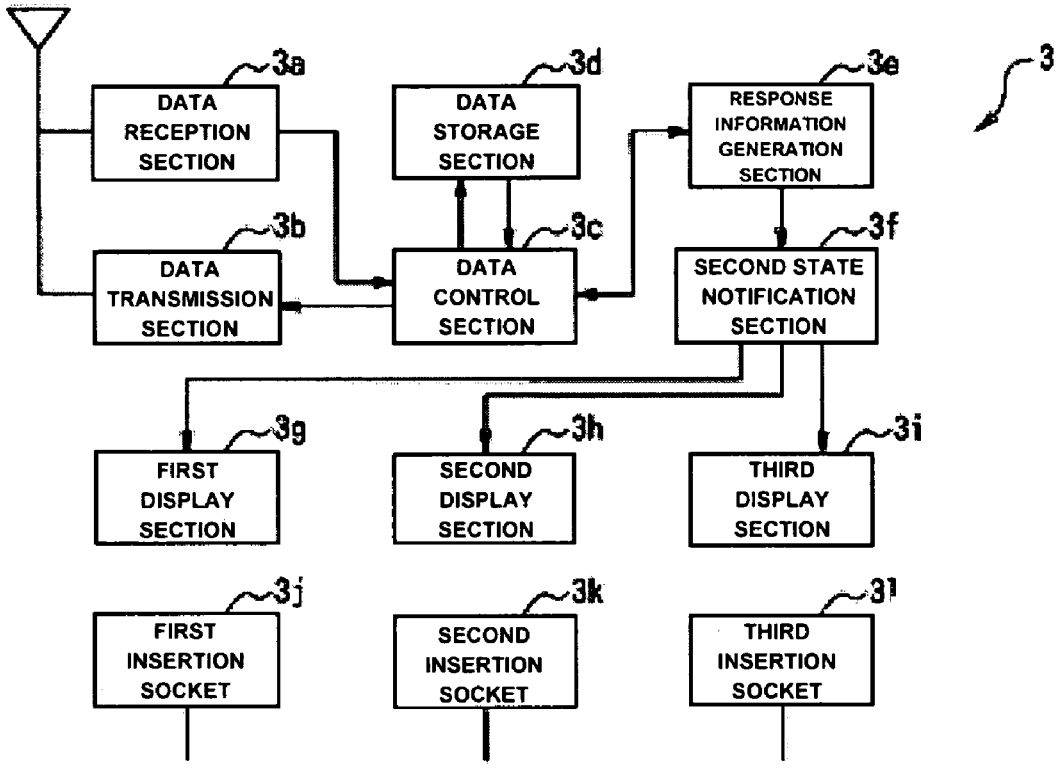
FIG. 3 is a block diagram of a detailed structure of a plug insertion section 3.

Further, referring to FIG. 3, details of the structure of the plug insertion section 3 will be described. FIG. 3 is a block diagram of a detailed structure of the plug insertion section 3.

As indicated in FIG. 3, the plug insertion section 3 has a structure including a data reception section 3*a*, a data transmission section 3*b*, a data control section 3*c*, a data storage section 3*d*, a response information generation section 3*e*, a second state notification section 3*f*, first through third display sections 3*g*-3*i*, and first through third insertion sockets 3*j*-3*l*.

The data reception section 3*a* has a function to receive by an electromagnetic induction method data transmitted from the plug 2.

The data transmission section 3*b* has a function to transmit specified data to the plug 2 by an electromagnetic induction method.

The data control section 3*c* executes a control program stored in the data storage section 3*d* by a CPU (Central Processing Unit) not shown, to thereby govern and control operations of the respective sections of the plug insertion section 3. Contents subject to the control include a control of data communications processings by an electromagnetic induction method using the data reception section 3*a* and the data transmission section 3*b*, such as, reception of data from the plug 2 and transmission of data to the plug 2. Further, it includes a control of processings to transfer data received from the plug 2 to the response information generation section 3*e*.

The data storage section 3*d* stores a control program, stores data received from the plug 2, and stores data used for processings conducted at each of the sections such as the data control section 3*c*, the response information generation section 3*e*, and the second state notification section 3*f*.

The response information generation section 3*e* judges, based on information of a matching insertion socket received from the plug 2, as to whether or not the plug insertion section 3 has an insertion socket matching with the information, and generates response information to the plug 2 based on a result of the judgment.

The second state notification section 3*f* generates, based on the response information generated by the response information generation section 3*e*, a light emission command for the first through third display sections 3*g*-3*i*, and transmits the command.

Each of the first through third display sections 3*g*-3*i* is formed from a plurality of light emitting elements, and the light emitting elements are made to emit light based on the light emission command generated by the second state notification section 3*f*, such that the user can be notified of the state of the first through third insert sockets 3*j*-3*l* for the plug 2. For example, when the plug 2 approaches a matching insertion socket, the light emitting elements are made to emit light such that they appear to be blue, and when it approaches a non-matching insertion socket, the light emitting elements are made to emit light such that they appear to be red. Also, the light emitting elements can be flashed. In other words, in the present embodiment, the first through third display sections 3*g*-3*i* have their light emitting elements emit light in the same colors as those of the display section 20*f* of the plug 2.

Figure 4:
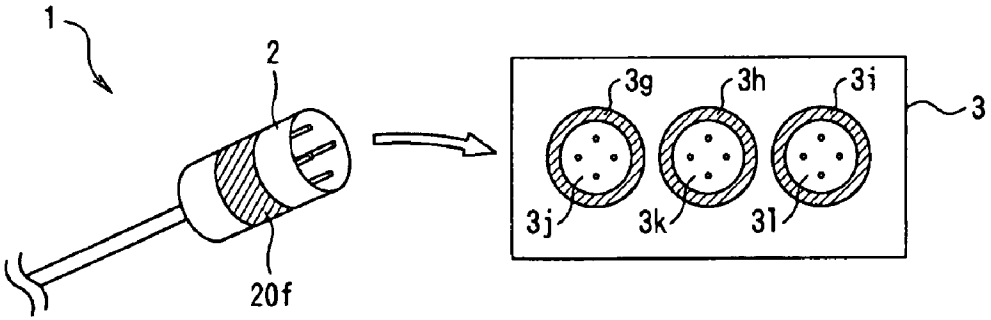
FIG. 4(*a*) is a diagram illustrating a first embodiment of a plug error insertion prevention system 1.
Figure 4:
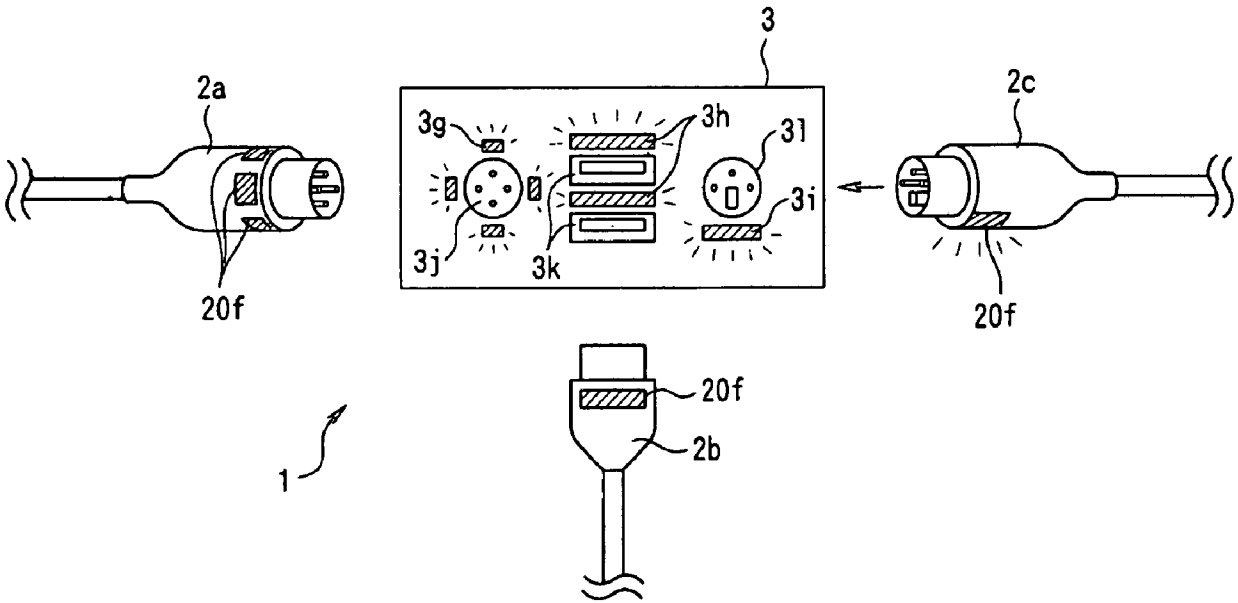

Further, referring to FIG. 4, more particular operations of the present system will be described. FIG. 4(*a*) shows a first embodiment of the plug error insertion prevention system 1, and FIG. 4(*b*) shows a second embodiment of the plug error insertion prevention system 1.

First, the first embodiment shown in FIG. 4(*a*) will be described. As shown in FIG. 4(*a*), the plug error insertion prevention system 1 of the first embodiment has a structure including a plug 2 having a main body with a display section 20*f* wound around, and a plug insertion section 3 having three insertion sockets in the same shape.

First, when the user of the plug 2 brings the plug 2 closer to the plug insertion section 3, the plug 2 receives a response request signal from the plug insertion section 3.

Here, in the present embodiment, the plug insertion section 3 transmits, by using the data control section 3*c*, a response request signal at a predetermined cycle through the data transmission section 3*b*. The plug 2 receives by its antenna 20*h* of the contactless identification tag 20 the response request signal from the plug insertion section 3, and generates driving electric power by the power generation section 20*g* from carrier wave of the response request signal, and supplies the power to each section of the contactless identification tag 20.

By this, the data reception section 20*a* to which the power is supplied demodulates the received signal and retrieves a response request; according to the response request, information for identifying an insertion socket (e.g., a model number of the insertion socket) in which the plug 2 can be inserted is read out by the data control section 20*c* from the data storage section 20*d*, and transmitted through the data transmission section 20*b* to the plug insertion section 3.

In the meantime, as the plug insertion section 3 receives the identification information through the data reception section 3*a* from the plug 2, the data control section 3*c* reads out from the data storage section 3*d* information of the insertion sockets of the plug insertion section 3, and transmits the information together with the identification information to the response information generation section 3*e*. The response information generation section 3*e* judges based on the obtained identification information and the information of the insertion sockets as to whether the plug 2 can use the insertion sockets, generates response information including a result of the judgment, and transmits the result to the data control section 3*c* and the second state notification section 3*f*.

The data control section 3*c*, upon receiving the response information from the response information generation section 3*e*, transmits the same through the data transmission section 3*b* to the plug 2. Also, upon receiving the response information from the response information generation section 3*e*, the second state notification section 3*f* generates, based on the result of the judgment included in the response information, a control command for controlling the display of the first through third display sections 3*g*-3*i* corresponding respectively to the first through third insertion sockets 3*j*-3*l* and transmits the control command thereto. The first through third display sections 3g-3i make the light emitting elements emit light in predetermined colors according to the control command received from the second state notification section 3f, thereby notifying the user of the states of the respective insertion sockets 3j-3l. For example, when the insertion socket 3k is recognized as a matching insertion socket for the plug 2 based on the response information, first, the second state notification section 3f generates a control command to light up the light emitting elements of the second display section 3h corresponding to the insertion socket 3k in a blue color, and transmits the same to the second display section 3h. Then, the second state notification section 3f, generates a control command to light up the light emitting elements of the first display section 3g corresponding to the first insertion socket 3j and the third display section 3i corresponding to the third insertion socket 3l in a red color, and transmits the same to the display sections 3g and 3i. In other words, by these control commands, the first display section 3g and the third display section 3i emit light in a red color, and the second display section 3h emits light in a blue color. If, in the present embodiment, the plug insertion section 3 does not have any insertion socket that matches with the plug 2, the display sections 3g-3i emit light in a red color.

As the contactless identification tag 20 of the plug 2 receives the response information signal including the response information from the plug insertion section 3 through the antenna 20h, the electric power generation section 20g generates driving electric power from carrier wave of the response information signal received and supplies the same to each section in like manner as it receives the response request signal. The data reception section 20a that is supplied with the electric power demodulates the received signal to retrieve the response information, and transmits the same to the data control section 20c. Then, the data control section 20c transmits the response information obtained from the data reception section 20a to the first state notification section 20e.

The first state notification section 20e receives the response information from the data control section 20c, generates a control command based on the response information to control the display of the display section 20f, and sends the same to the display section 20f. Upon receiving the control command from the first state notification section 20e, the display section 20f makes the light emitting elements composing the display section 20f emit light in a specified color based on the contents of the command. In the present embodiment, when the plug insertion section 3 has an insertion socket that matches with the plug 2, the first state notification section 20e generates a control command to make the light emitting elements emit light such that the display section 20f lights up in a blue color, and transmits the same to the display section 20f. On the other hand, when the plug insertion section 3 does not have an insertion socket that matches with the plug 2, the first state notification section 20e generates a control command to make the light emitting elements emit light such that the display section 20f lights up in a red color, and transmits the same to the display section 20f. Accordingly, the display section 20f lights up in a blue color when the plug insertion section 3 has an insertion socket that matches with the plug 2, and lights up in a red color when it does not have a matching insertion socket.

Eventually, the user of the plug 2 compares the displayed content of the display section 20f of the plug 2 and the displayed content of the first through third display sections 3g-3i of the plug insertion section 3, selects an insertion socket with its display section emitting light in a blue color, and connects the connection section 21 of the plug 2 to that insertion socket.

Further, referring to FIG. 4(b), a second embodiment of the plug error insertion prevention system 1 will be described.

As indicated in FIG. 4(b), the plug error insertion prevention system 1 of the second embodiment has a structure including first through third plugs 2a-2c having mutually different shapes (in particular, with connection sections 21 having different shapes), and a plug insertion section 3 including first through third insertion sockets 3j-3l having mutually different shapes. Here, the first through third plugs 2a-2c have the same structure as that of the plug 2 in the first embodiment except that their external shapes and the shapes of the connection sections 21 are different.

Like the first embodiment described above, when the user of the first through third plugs 2a-2c brings any of the first through third plugs 2a-2c closer to the plug insertion section 3, the first through third plugs 2a-2c receive a response request signal from the plug insertion section 3.

First, a description will be made as to the case when the first plug 2a is approached. When the first plug 2a approaches the plug insertion section 3, the first plug 2a receives a response request signal from the plug insertion section 3. The response request signal is received by the antenna 20h of the contactless identification tag 20 of the first plug 2a, like in the case of the first embodiment. By this, the power generation section 20g of the contactless identification tag 20 generates driving electric power from carrier wave of the received signal, and supplies the power to each section of the contactless identification tag 20.

By this, the data reception section 20a to which the power is supplied demodulates the received signal and retrieves a response request; according to the response request, information for identifying an insertion socket (e.g., a model number of the insertion socket) in which the first plug 2a can be inserted is read out by the data control section 20c from the data storage section 20d, and transmitted through the data transmission section 20b to the plug insertion section 3.

In the meantime, as the plug insertion section 3 receives the identification information through the data reception section 3a from the first plug 2a, the data control section 3c reads out from the data storage section 3d information of the insertion sockets of the plug insertion section 3, and transmits the information together with the identification information to the response information generation section 3e. The response information generation section 3e judges based on the obtained identification information and the information of the insertion sockets as to whether the first plug 2a can use the insertion sockets, generates response information including a result of the judgment, and transmits the result to the data control section 3c and the second state notification section 3f. Here, since there is the first insertion socket 3j that matches with the plug 2a, it is judged that the first insertion socket 3j is usable, and response information including the judgment result is generated.

The data control section 3c, upon receiving the response information from the response information generation section 3e, transmits the same through the data transmission section 3b to the plug 2. Also, upon receiving the response information from the response information generation section 3e, the second state notification section 3f generates, based on the result of the judgment included in the response information, a control command for controlling the display of the first through third display sections 3g-3i corresponding respectively to the first through third insertion sockets 3*j*-3*l*, and transmits the control command to the first through third display sections 3*g*-3*i*. In this case, the second state notification section 3*f* generates control commands to make the light emitting elements of the first display section 3*g* emit light in a blue color and to make the light emitting elements of the second and third display sections 3*h* and 3*i* emit light in a red color, and transmits the same to the respective display sections.

Then, the first through third display sections 3*g*-3*i* make the light emitting elements emit light according to the control commands received from the second state notification section 3*f*, to thereby notify the user of the states of the respective insertion sockets 3*j*-3*l*. Here, the first display section 3*g* corresponding to the insertion socket 3*j*, which is an insertion socket that matches with the first plug 2*a*, lights up in a blue color, and the second display section 3*h* corresponding to the second insertion socket 3*k* and the third display section 3*i* corresponding to the third insertion socket 3*l* light up in a red color.

Also, as the contactless identification tag 20 of the first plug 2*a* receives the response information signal including the response information from the plug insertion section 3 through the antenna 20*h*, the electric power generation section 20*g* generates driving electric power from carrier wave of the response information signal received and supplies the same to each section, in like manner as it receives the response request signal. The data reception section 20*a* that is supplied with the electric power demodulates the received signal to retrieve the response information, and transmits the same to the data control section 20*c*. Then, the data control section 20*c* transmits the response information obtained from the data reception section 20*a* to the first state notification section 20*e*.

The first state notification section 20*e* receives the response information from the data control section 20*c*, generates a control command based on the response information to make the light emitting elements of the display section 20*f* emit light in a blue color, and sends the same to the display section 20*f*. Upon receiving the control command from the first state notification section 20*e*, the display section 20*f* makes the light emitting elements composing the display section 20*f* to emit light in a blue color based on the contents of the command.

Eventually, the user of the first plug 2*a* compares the displayed content (emitting light in a blue color) of the display section 20*f* of the first plug 2*a* and the displayed content of the first through third display sections 3*g*-3*i* of the plug insertion section 3, selects the first insertion socket 3*j* with its display section emitting light in a blue color, and connects the connection section 21 of the first plug 2*a* to that insertion socket. The display section 20*f* of the plug 2*a* may be divided into four sections that are disposed at positions corresponding to the four pins of the connection section 21, and also, the first display section 3*g* corresponding to the first insertion section 3*j* in the plug insertion section 3 may be divided into four sections that are disposed at positions corresponding to the four pin insertion sockets corresponding to the respective pins of the first plug 2*a*. Accordingly, through matching the positions of the display sections of the first plug 2*a* and the first insertion socket 3*j*, the user of the first plug 2*a* can guide the first plug 2*a* to the right position of the insertion socket 3*j*, and can readily insert the connection section 21 of the first plug 2*a* into the first insertion socket 3*j*.

Also, when the second plug 2*b* is brought closer to the plug insertion section 3, processings similar to those conducted for the first plug 2*a* are conducted, whereby the second plug 2*b* makes the display section 20*f* emit light in a blue color, and the plug insertion section 3 makes the second display section 3*h* corresponding to the second insertion socket 3*k* that matches with the second plug 2*b* emit light in a blue color, and the first display section 3*g* and the third display section 3*i* corresponding to the other insertion sockets in a red color.

Then, eventually, the user of the second plug 2*b* compares the displayed content (emitting light in a blue color) of the display section 20*f* of the second plug 2*b* and the displayed contents of the first through third display sections 3*g*-3*i* of the plug insertion section 3, selects the second insertion socket 3*k* whose display section emits light in a blue color, and inserts the connection section 21 of the second plug 2*b* therein. Here, as indicated in FIG. 4(*b*), there are two second insertion sockets 3*k*. In the present embodiment, the second plug 2*b* matches with both of them, and can be inserted in either of them without a problem. It is noted that the display section 20*f* is disposed on the second plug 2*b* at a position indicated in FIG. 4(*b*), and the second display section 3*h* in the plug insertion section 3 corresponding to the second insertion socket 3*k* is disposed at a position corresponding to the display section 20*f* of the plug 2*b*. Accordingly, by mutually matching the positions of the display sections of the second plug 2*b* and the second insertion socket 3*k*, the user of the second plug 2*b* can guide the second plug 2*b* to a correct position of the second insertion socket 3*k*, and can readily insert the connection section 21 of the second plug 2*b* into the second insertion socket 3*k*.

Also, when the third plug 2*c* is brought closer to the plug insertion section 3, processings similar to those conducted for the first plug 2*a* or the second plug 2*b* are conducted, whereby the third plug 2*c* makes the display section 20*f* emit light in a blue color, and the plug insertion section 3 makes the third display section 3*i* corresponding to the third insertion socket 31 that matches with the third plug 2*c* emit light in a blue color, and the first display section 3*g* and the second display section 3*h* corresponding to the other insertion sockets in a red color.

Then, eventually, the user of the third plug 2*c* compares the displayed content (emitting light in a blue color) of the display section 20*f* of the third plug 2*c* and the displayed contents of the first through third display sections 3*g*-3*i* of the plug insertion section 3, selects the third insertion socket 3*l* whose display section emits light in a blue color, and inserts the connection section 21 of the third plug 2*c* therein. It is noted that the display section 20*f* is disposed on the third plug 2*c* at a position indicated in FIG. 4(*b*), and the third display section 3*i* in the plug insertion section 3 corresponding to the third insertion socket 3*l* is disposed at a position corresponding to the display section 20*f* of the third plug 2*c*. Accordingly, by mutually matching the positions of the display sections of the third plug 2*c* and the third insertion socket 3*l*, the user of the third plug 2*c* can guide the third plug 2*c* to a correct position of the third insertion socket 3*l*, and can readily insert the connection section 21 of the third plug 2*c* into the third insertion socket 3*l*.

Further, there is described a third embodiment of the plug error insertion prevention system 1, in which, in the first embodiment or the second embodiment of the plug error insertion prevention system 1, the plug 2 side is provided with identification information characteristic to a user, and this identification information is included in the above described identification information and returned in response to a response request from the plug insertion section 3.

Initially, all identification information of users permitted to use the plug are stored in advance in the data storage section 3*d* of the plug insertion section 3. Then, the response information generation section 3*e* generates response information based on the information of an insertion socket that matches with the plug 2 and the identification information characteristic to the user, which are included in the identification information received from the plug 2. In this instance, judgments are made as to whether or not there is an insertion socket that matches with the plug 2, as well as whether the identification information characteristic to the user is present in the identification information of users permitted to use stored in the data storage section 3*d*. Based on a result of the judgment, if the received identification information indicates that the use is permitted, and the plug insertion section 3 has an insertion socket that matches with the plug 2, the display section of the matching insertion socket is made to emit light in a blue color. On the other hand, when the received identification information indicates that the use is not permitted, all of the display sections at the insertion sockets on the side of the plug insertion section 3 are made to emit light in a red color, even when there is an insertion socket whose standard (configuration) matches with the plug 2, and information indicating that there is no insertion socket usable by the plug 2 is included in the response information to be sent back to the plug 2 is transmitted.

Accordingly, when the plug insertion section 3 side judges that the use is not possible, the display section 20*f* on the plug 2 side is always made to emit light in a red color. It is noted that the plug insertion section 3 side may be equipped with a device that disconnects the electrical connection when the plug 2 is inserted, when the use is not possible according to the identification information received from the plug 2. Accordingly, even when the plug 2 that cannot be used is inserted, the use of the insertion socket can be physically prevented.

Figure 5:
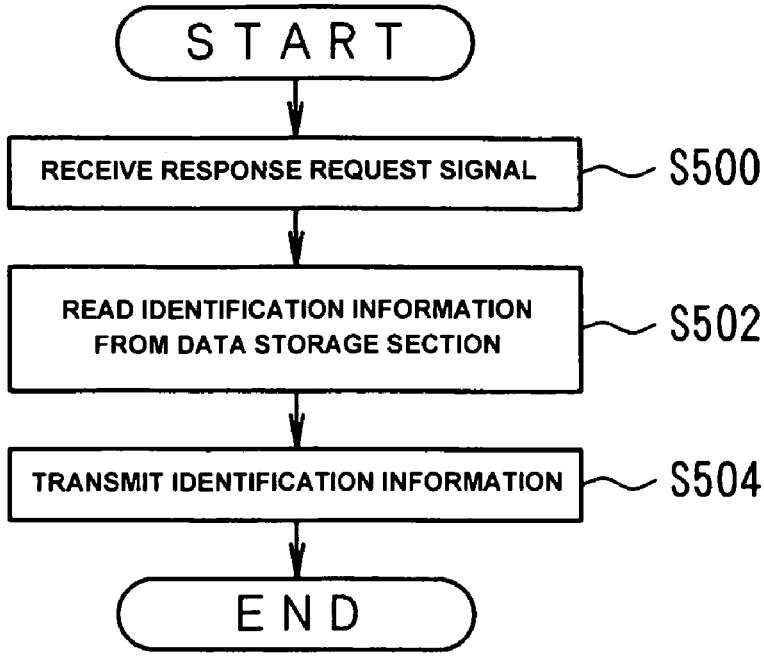
FIG. 5 is a flowchart of operation processings which take place at the plug 2 after power supply in response to a response request.

Further, referring to FIG. 5, a flow of operation processings which take place at the plug 2 in response to a response request after the power supply will be described. FIG. 5 is a flowchart indicating operation processings which take place at the plug 2 in response to a response request after the power supply As indicated in FIG. 5, the process initially proceeds to step S500, wherein a response request signal is received from the plug insertion section 3, and then proceeds to step S502.

In step S502, the data control section 20*c* reads identification information from the data storage section 20*d*, and then the process proceeds to step S504.

In step S504, the data control section 20*c* transmits the identification information read out to the plug insertion section 3 through the data transmission section 20*b* and the antenna 20*h*, and the process ends.

Figure 6:
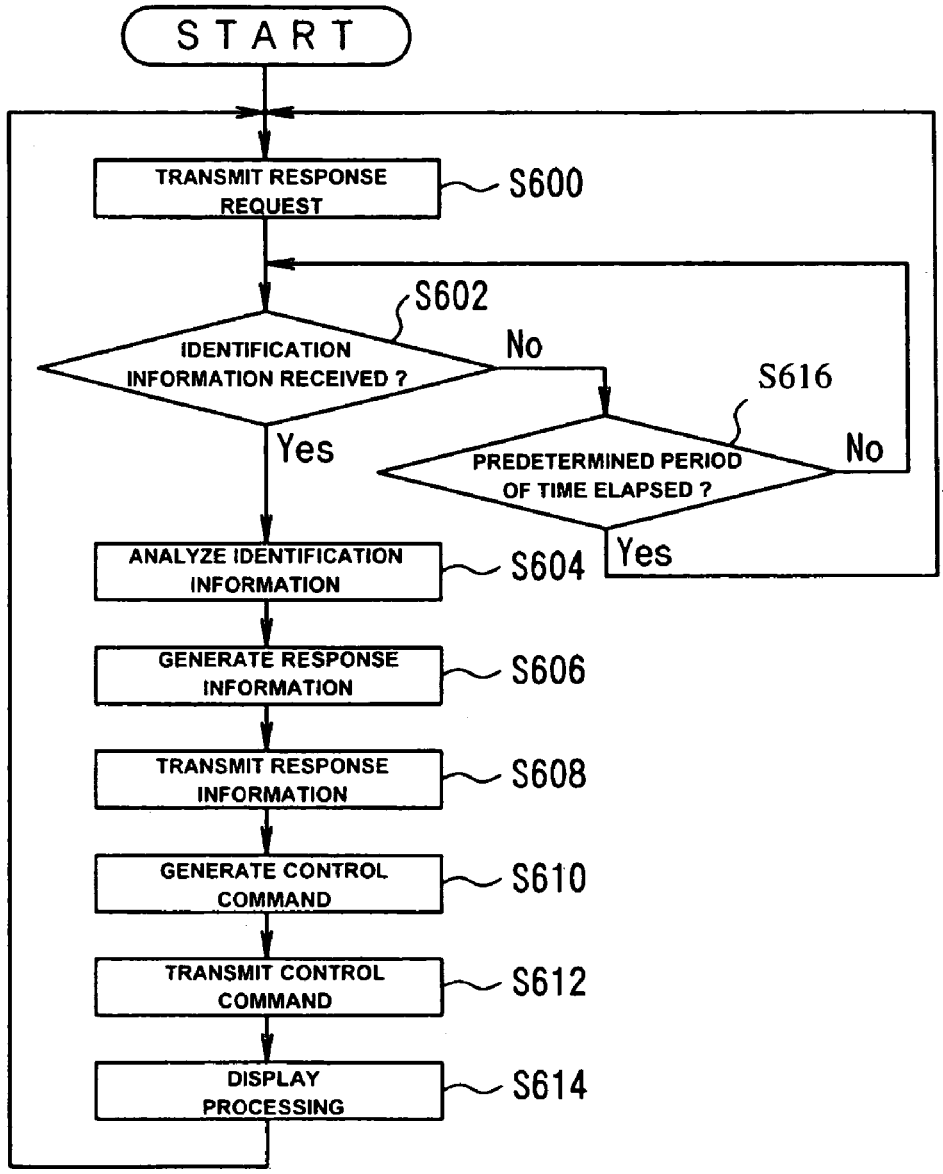
FIG. 6 is a flowchart of operation processings conducted by the plug insertion section 3.

Further, referring to FIG. 6, a flow of operation processings of the plug insertion section 3 is described. FIG. 6 is a flowchart indicating operation processings which take place at the plug insertion section 3.

As indicated in FIG. 6, the process initially proceeds to step S600, where the data control section 3*c* transmits a response request signal to the plug 2 through the data transmission section 3*b*, and then proceeds to step S602.

In step S602, the data control section 3*c* judges whether or not identification information has been received from the plug 2, and proceeds to step S604 when it is judged that it has been received (Yes), but proceeds to step S616 when it has not been received (No).

When the process proceeds to step S604, the response information generation section 3*e* analyzes the identification information received from the plug 2, and proceeds to step S606. The analysis conducted here includes, in the first and second embodiments, comparing the identification information received from the plug 2 which includes information about an insertion socket that matches with the plug 2 and the information about the insertion sockets of the plug insertion section 3 side, and judging whether or not there is an insertion socket that matches the plug 2. Also, in the third embodiment, the analysis further includes, in addition to the judgment conducted in the first and second embodiments, comparing identification information about a user received from the plug 2 and the list of identification information of users permitted to use the plug which is stored in the plug insertion section 3, and judging whether or not the user of the plug 2 is permitted to use it.

In step S606, the response information generation section 3*e* generates response information based on the analysis result, and the process proceeds to step 608.

In step 608, the data control section 3*c* transmits the response information generated to the plug 2 through the data transmission section 3*b*, and further, transfers the same to the second state notification section 3*f*, and the process proceeds to step S610.

In step S610, the second state notification section 3*f* generates, based on the obtained response information, a control command to control the display of the first through third display sections 3*g*-3*i*, and the process proceeds to step S612.

In step S612, the second state notification section 3*f* transfers the generated control command to the first through third display sections 3*g*-3*i*, and the process proceeds to step S614.

In step S614, the first through third display sections 3*g*-3*i* display their display sections in specified colors according to the obtained control command, and the process proceeds to step S600.

Also, when the process proceeds to step S616 as step S602 finds no identification information received, the data control section 3*c* judges whether or not a predetermined period of time has elapsed; and the process proceeds to step S600 when it is judged that the specified period of time has elapsed (Yes), but proceeds to step S602 when it has not (No).

Figure 7:
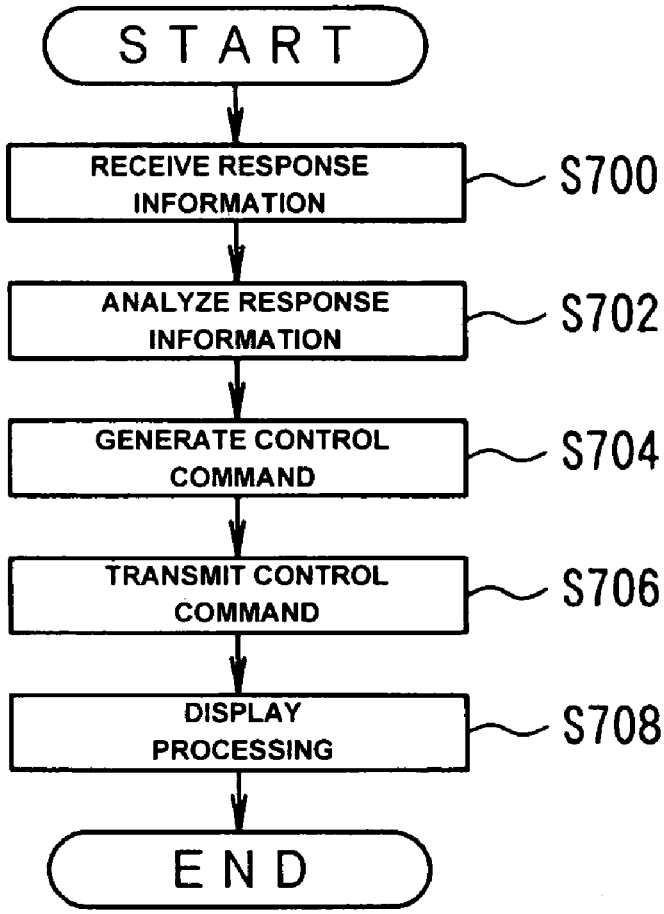
FIG. 7 is a flowchart of operation processings which take place at the plug 2 after power supply in response to response information sent from the plug insertion section 3.

Further, referring to FIG. 7, a flow of operation processings which take place at the plug 2 in response to the response information from the plug insertion section 3 after the power supply will be described. FIG. 7 is a flowchart of operation processings which take place at the plug 2 in response to the response information from the plug insertion section 3 after the power supply.

As indicated in FIG. 7, the process initially proceeds to step S700, wherein the data control section 3*c* receives the response information from the plug insertion section 3 through the data reception section 20*a*, and transfer the same to the first state notification section 20*e*, and the process proceeds to step S702.

In step S702, the first state notification section 20*e* analyzes the response information received from the data control section 20*c*, and the process proceeds to step S704.

In step S704, the first state notification section 20*e* generates a control command to control the display of the display section 20*f* based on a result of the analysis, and the process proceeds to step S706.

In step S706, the first state notification section 20*f* transmits the control command generated to the display section 20*f*, and the process proceeds to step S708.

In step S708, the display section 20*f* displays the display section in a specified color according to the control command obtained from the first state notification section 20*e*, and the process ends.

As described above, as the plug 2 approaches the plug insertion section 3, it is possible to know whether or not the plug insertion section 3 has an insertion socket that matches with the plug 2. Consequently, the user of the plug 2 can be prevented from inserting the plug 2 into the wrong insertion socket.

Also, the display section is formed from light emitting elements, and the light emitting elements are made to emit light to thereby display relevant conditions, for example, as to whether or not the plug 2 approaching matches with the plug insertion section 3. Consequently, the user of the plug 2 can readily learn by visual observation whether or not they match with each other, and can readily learn the state as the light emitting elements grow in the darkness.

Also, due to the fact that the display section on the plug 2 and the display section corresponding to each insertion socket of the plug insertion section 3 are provided at positions where they can be aligned at the time of insertion, the user can align the positions of the display section on the plug 2 and the display section at each insertion socket of the plug insertion section 3, such that the plug 2 can be readily inserted in a correct positional relation.

Here, referring to FIG. 2, the data storage section 20*d* corresponds to the first identification information storage means recited in the first, second and thirteenth aspects; the first state notification section 20*e* corresponds to the plug state notification means recited in the first, second, fourth, seventh and thirteenth aspects; the processing to transmit identification information through the data transmission section 20*b* and the antenna 20*h* which is conducted by the data control section 20*c* corresponds to the plug insertion socket information transmission means recited in the first, second and thirteenth aspects; the processing to receive response information through the data reception section 20*a* and the antenna 20*h* which is conducted by the data control section 20*c* corresponds to the response information reception means recited in the first, second and thirteenth aspects; the processing to notify the user of the state of the plug 2 conducted by the first state notification section 20*e* and the display section 20*f* corresponds to the plug state notification means recited in the first, second, fourth, seventh and thirteenth aspects; and the power generation section 20*g* corresponds to the electric power generation means recited in the third aspect. Referring to FIG. 3, the data storage section 3*d* corresponds to the second identification information storage means recited in the first and fourteenth aspects; the processing to receive identification information sent from the plug 2 and conducted through the data reception section 3*a* by the data control section 3*c* corresponds to the first identification information reception means recited in the first and fourteenth aspects; the processing to compare and judge identification information sent from the plug 2 with respect to information about insertion sockets of the plug insertion section 3 corresponds to the identification information comparison means recited in the first and fourteenth aspects; the processing to generate response information by the response information generation section 3*e* corresponds to the response information generation means recited in the first, twelfth and fourteenth aspects; the processing to transmit response information to the plug 2 through the data transmission section 3*b* which is conducted by the data control section 3*c* corresponds to the response information transmission means recited in the first and fourteenth aspects; the processing to notify the user of the states of the insertion sockets by the second state notification section 3*f* and the first through third display sections 3*g*-3*i* corresponds to the plug insertion socket state notification means recited in the first, eighth and fourteenth aspects; the processing to transmit data using carrier waves of various kinds of signals to the plug 2 through the data transmission section 3*b* which is conducted by the data control section 3*c* corresponds to the power supply electromagnetic wave transmission means recited in the third aspect; and the first insertion socket 3*g* through the third insertion socket 3*i* correspond to the plug insertion sockets recited in the first, second and fourth-seventeenth aspects.

It is noted that, in the embodiments described above, by light emission of light emitting elements, the states of the plug 2 and each insertion socket of the plug insertion section are notified to the user. However, without being limited to these embodiments, the states may be notified to the user by other display devices such as electrophoretic display devices, voice outputs or the like.

What is claimed is:

1. A plug error insertion prevention system that prevents a plug intended for use with a specified plug insertion socket of a plug insertion section from being inserted into an incorrect plug insertion socket of the plug insertion section, the system comprising:

the plug; and the plug insertion section;

wherein the plug includes:

an electric power generation unit that generates electric power to drive the plug, the electric power being generated by an electromagnetic wave from the plug insertion section;

a first identification information storage unit that stores first identification information for identifying the specified plug insertion socket corresponding to the plug;

a first identification information transmission unit that sends the first identification information to a desired plug insertion socket;

a response information receiving unit that receives response information from the plug insertion section; and a plug state notification unit that notifies a system user of a plug state relative to the desired plug insertion socket based on the response information received by the response information receiving unit, and wherein the plug insertion section includes:

a second identification information storage unit that stores second identification information for identifying the plug corresponding to the specified plug insertion socket;

a first identification information receiving unit that receives the first identification information from the plug;

an identification information comparing unit that compares the first identification information received by the first identification information receiving unit and the second identification information;

a response information generation unit that generates response information to the plug based on a comparison result of the identification information comparing unit;

a response information transmission unit that sends the response information generated by the response information generation unit to the plug; and a plug insertion socket state notification unit that notifies the system user of a plug insertion socket state relative to the plug.

2. The plug error insertion prevention system according to claim 1, wherein:

the plug insertion section is equipped with a power supply transmission unit that transmits the electromagnetic wave for supplying electric power to the plug.

3. The plug error insertion prevention system according to claim 1, wherein:

the plug is equipped with a contactless identification tag; and the contactless identification tag is equipped with the first identification information storage unit that stores the first identification information, the first identification information transmission unit, the response information receiving unit, and the plug state notification unit.

4. The plug error insertion prevention system recited in claim 3, further comprising:

a contactless identification tag control program for controlling the contactless identification tag, the program including:

a first identification information transmission step of sending the first identification information to the desired plug insertion socket when the plug approaches the desired plug insertion socket;

a response information receiving step of receiving response information from the plug insertion section; and a plug state notification step of notifying the system user of the plug state relative to the desired plug insertion socket based on the response information received in the response information receiving step.

5. The plug error insertion prevention system according to claim 1, wherein the plug state notification unit includes a plug state display section that displays specified information to notify the system user of the plug state.

6. The plug error insertion prevention system according to claim 5, wherein the plug state display section includes a light emitting element, and notifies the system user of the plug state by a mode of light emission.

7. The plug error insertion prevention system according to claim 6, wherein the plug state display section is disposed at a specified position of the plug at which a correct insertion position of the plug relative to the plug insertion socket can be guided.

8. The plug error insertion prevention system according to claim 6, wherein the plug state notification unit changes the mode of light emission of the light emitting element according to positions of the plug with respect to the plug insertion socket.

9. The plug error insertion prevention system according to claim 1, wherein the plug insertion socket state notification unit includes a plug insertion socket state display section, that displays specified information to notify the system user of the plug insertion socket state.

10. The plug error insertion prevention system according to claim 9, wherein the plug insertion socket state display section includes a light emitting element, and notifies the system user of the plug insertion socket state by the mode of light emission.

11. The plug error insertion prevention system according to claim 9, wherein the plug insertion socket state display section is disposed at a specified position of the plug insertion section at which a correct insertion position of the plug can be guided when inserting the plug into the plug insertion socket.

12. The plug error insertion prevention system according to claim 10, wherein the plug insertion socket state notification unit changes the mode of light emission of the light emitting element according to positions of the plug with respect to the plug insertion socket.

13. The plug error insertion prevention system according to claim 1, wherein:

the first identification information includes characteristic information of an authorized user of the plug;

the plug insertion section is equipped with a usability judging unit that judges whether the plug can use the specified plug insertion socket of the plug insertion section based on the characteristic information; and the response information generation unit generates the response information based also on a judgment result of the usability judging unit.

14. A plug error insertion prevention system comprising:

a plug; and a plug insertion section;

wherein the plug comprises:

an electric power generation unit that generates electric cower to drive the plug, the electric cower being generated by an electromagnetic wave from the plug insertion section;

a first identification information storage unit that stores first identification information for identifying a specified plug insertion socket corresponding to the plug;

a first identification information transmission unit that sends the first identification information to a desired plug insertion socket of the plug insertion section;

a response information receiving unit that receives response information from the plug insertion section; and a plug state notification unit that notifies a system user of a plug state relative to the plug insertion socket based on the response information.

15. The plug error insertion prevention system recited in claim 14, further comprising:

a plug control program for controlling the plug, the program including:

a first identification information transmission step of sending the first identification information to the desired plug insertion socket upon the plug approaching the desired plug insertion socket;

a response information receiving step of receiving response information from the plug insertion section; and a plug state notification step of notifying the a system the user of the plug state relative to the desired plug insertion socket based on the response information received in the response information receiving step.

16. A plug error insertion prevention system comprising:

a plug; and a plug insertion section;

wherein the plug insertion section includes:

a power supply transmission unit that transmits an electromagnetic wave for supplying electric power to the plug;

a second identification information storage unit that stores second identification information for identifying the plug corresponding to a specified plug insertion socket of the plug insertion section;

a first identification information receiving unit that receives first identification information from the plug;

an identification information comparing unit that compares the first identification information received by the first identification information receiving unit and the second identification information;

a response information generation unit that generates response information to the plug based on a comparison result of the identification information comparing unit;

a response information transmission unit that sends the response information generated by the response information generation unit to the plug; and a plug insertion socket state notification unit that notifies the system user of the plug insertion socket state relative to the plug.

17. The plug error insertion prevention system recited in claim 16, further comprising:

a plug insertion section control program for controlling the plug insertion section, the program including:

a first identification information receiving step of receiving the first identification information sent from the plug;

an information comparing step of comparing the first identification information received in the first identification information receiving step and the second identification information;

a response information generation step of generating response information to the plug based on a comparison result of the information comparing step;

a response information transmission step of sending the response information generated in the response information generation step to the plug; and a plug insertion socket state notification step of notifying the system user of the plug insertion socket state relative to the plug.

18. A plug error insertion prevention system comprising:

a plug; and a plug insertion section;

wherein the plug includes:

an electric power generation unit that generates electric power to drive the plug, the electric power being generated by an electromagnetic wave from the plug insertion section;

a first identification information memory storing first identification information identifying a specified socket suitable for the plug;

a socket information transmitter sending the first identification information to a desired socket of the plug insertion section;

a response information receiver receiving response information from the plug insertion section; and a plug state messenger notifying a system user of the plug suitability relative to the desired socket based on the response information, and wherein the plug insertion section includes:

a second identification information memory storing second identification information identifying a specified plug suitable for the desired socket;

a first identification information receiver receiving the first identification information from the plug;

an identification information comparator comparing the first and second identification information;

a response information generator generating response information based on a comparison result of the identification information comparator;

a response information transmitter sending the response information to the plug; and a socket suitability notifier notifying the system user of the desired socket suitability relative to the plug;

whereby the system prevents the plug from being inserted into an incorrect socket of the plug insertion section.

19. A plug error insertion prevention system that prevents a plug intended for use with a specified plug insertion socket of a plug insertion section from being inserted into an incorrect plug insertion socket of the plug insertion section, the system comprising:

the plug; and the plug insertion section;

wherein the plug includes an electric power generation unit that generates electric power to drive the plug, the electric power being generated by an electromagnetic wave from the plug insertion section; and wherein the plug insertion section includes a power supply transmission unit that transmits the electromagnetic wave to the plug.

20. A plug for a plug error insertion prevention system that prevents a plug intended for use with a specified plug insertion socket of a plug insertion section from being inserted into an incorrect plug insertion socket of the plug insertion section, the plug comprising:

an electric power generation unit that generates electric power to drive the plug, the electric power being generated by an electromagnetic wave from a power supply transmission unit of the plug insertion section that transmits the electromagnetic wave to the plug.

* * * * *